US010539404B1

(12) United States Patent
Lustig et al.

(10) Patent No.: US 10,539,404 B1
(45) Date of Patent: Jan. 21, 2020

(54) BLAST CONTAINMENT SYSTEM FOR TRASH CANS

(71) Applicant: The United States of America as Represented by the Secretary of the Navy, Washington, DC (US)

(72) Inventors: Edward A. Lustig, Charlotte Hall, MD (US); Eric Gahagan, Winthrop, MA (US); John W. Monico, Jr., Stafford, VA (US); Paul C. Perricone, New York City, NY (US); William Qualls, Plymouth, MA (US); Michael Agens, Columbia, NJ (US); Daniel C. Jones, Stow, MA (US); John Winslow, Falls Church, VA (US); Michael Murray, Worcester, MA (US); Kimberly Peranich, Sr., White Plains, MD (US); Lee Foltz, Indian Head, MD (US); Jesse Stuart Moran, Alexandria, VA (US); Christopher Wilhelm, Port Tobacco, MD (US); Lesley Wilhelm, Port Tobacco, MD (US); John Wilkinson, Charlotte Hall, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/932,602

(22) Filed: Mar. 23, 2018

(51) Int. Cl.
*F42D 5/045* (2006.01)
*B65F 1/02* (2006.01)

(52) U.S. Cl.
CPC ..... *F42D 5/045* (2013.01); *B65F 1/02* (2013.01)

(58) Field of Classification Search
CPC ..... F42D 5/045
USPC ..... 86/50
See application file for complete search history.

(56) References Cited

U.S. PATENT DOCUMENTS 3,739,731 A * 6/1973 Tabor ..... F42B 33/06 109/49.5
3,800,715 A * 4/1974 Boller ..... F42B 33/067 109/1 R
4,543,872 A 10/1985 Graham et al.
4,836,079 A 6/1989 Barrett
6,302,026 B1 10/2001 Parkes
6,397,753 B2 6/2002 Keenan et al.
7,213,494 B2 5/2007 James
7,343,843 B2 * 3/2008 Sharpe ..... B65D 90/325 86/50

(Continued)

FOREIGN PATENT DOCUMENTS

WO WO 2007106229 A2 * 9/2007 ..... F42D 5/045

*Primary Examiner* — Bret Hayes
(74) *Attorney, Agent, or Firm* — Fredric J. Zimmerman

(57) ABSTRACT

A blast containment system for trash cans includes a liquid-impervious flexible bag having a sealed bottom positioned at a base of a trash can, and an unsealed top positioned and retained at a top periphery of the trash can. A ring-shaped boot is positioned at the sealed bottom of the flexible bag. A rigid container has a closed bottom press-fit into a central opening of the boot. The rigid container extends from its closed bottom to an open top adapted to be approximately aligned with the top periphery of the trash can. An annular volume is defined between the rigid container the flexible bag. The rigid container has side walls that include ballistic materials. A liquid fills the annular volume.

20 Claims, 2 Drawing Sheets

(56) References Cited

U.S. PATENT DOCUMENTS

| | | | | |
|---|---|---|---|---|
| 7,490,637 | B2 | 2/2009 | Speasl et al. | |
| 7,954,415 | B2 | 6/2011 | Warren et al. | |
| 2004/0134335 | A1* | 7/2004 | Holland | B65F 1/1426 86/50 |
| 2005/0252915 | A1* | 11/2005 | Schmidt | B65F 1/02 220/88.1 |
| 2008/0098879 | A1* | 5/2008 | Parkes | F42B 33/06 86/50 |
| 2008/0121100 | A1* | 5/2008 | Pastrnak | F41H 5/08 89/36.09 |
| 2008/0282874 | A1* | 11/2008 | Ogden | B65F 1/14 86/50 |
| 2017/0045335 | A1* | 2/2017 | Abbe | F41H 5/0414 |
| 2017/0299363 | A1* | 10/2017 | Germani | F42D 5/045 |
| 2019/0041180 | A1* | 2/2019 | Ohlson | F42B 39/14 |

* cited by examiner

BLAST CONTAINMENT SYSTEM FOR TRASH CANS

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to blast containment systems, and more particularly to a blast containment system for placement in existing trash cans.

BACKGROUND OF THE INVENTION

Current blast-resistant trash receptacles are heavy-duty steel containment vessels that may be used for the purpose of mitigating the effects of pressure and fragmentation from certain types of threats (pipe bomb, backpack, etc.) by helping to mitigate the blast effects of a detonation via containment. However, in their current form, these receptacles can weigh thousands of pounds, cost thousands of dollars each, and provide no capability for use with flash x-ray or many detonation-prevention procedures while the threat is inside the receptacle. These drawbacks limit the practicality and use of current blast-resistant trash receptacles at special events and/or transportation hubs.

SUMMARY OF THE INVENTION

Accordingly, it is an object of the present invention to provide a blast containment system adaptable for use with a variety of existing trash cans.

Another object of the present invention is to provide a blast containment system that may be readily transported to and readily deployed in existing trash cans at special events and/or transportation hubs.

Still another object of the present invention is to provide a cost-effective blast containment system that can be deployed in existing trash cans.

Other objects and advantages of the present invention will become more obvious hereinafter in the specification and drawings.

In accordance with the present invention, a blast containment system for trash cans includes a flexible bag adapted to be positioned in a rigid trash can. The flexible bag has a sealed bottom adapted to be positioned at a base of the trash can, and an unsealed top adapted to be positioned and retained at a top periphery of the trash can. The flexible bag is impervious to liquid. A ring-shaped boot is positioned at the sealed bottom of the flexible bag. The boot has a central opening. A rigid container has a closed bottom press-fit into the central opening of the boot. The rigid container extends from its closed bottom to an open top thereof adapted to be approximately aligned with the top periphery of the trash can where an annular volume is defined between the rigid container the flexible bag. The rigid container has side walls that include ballistic materials. A liquid fills the annular volume.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
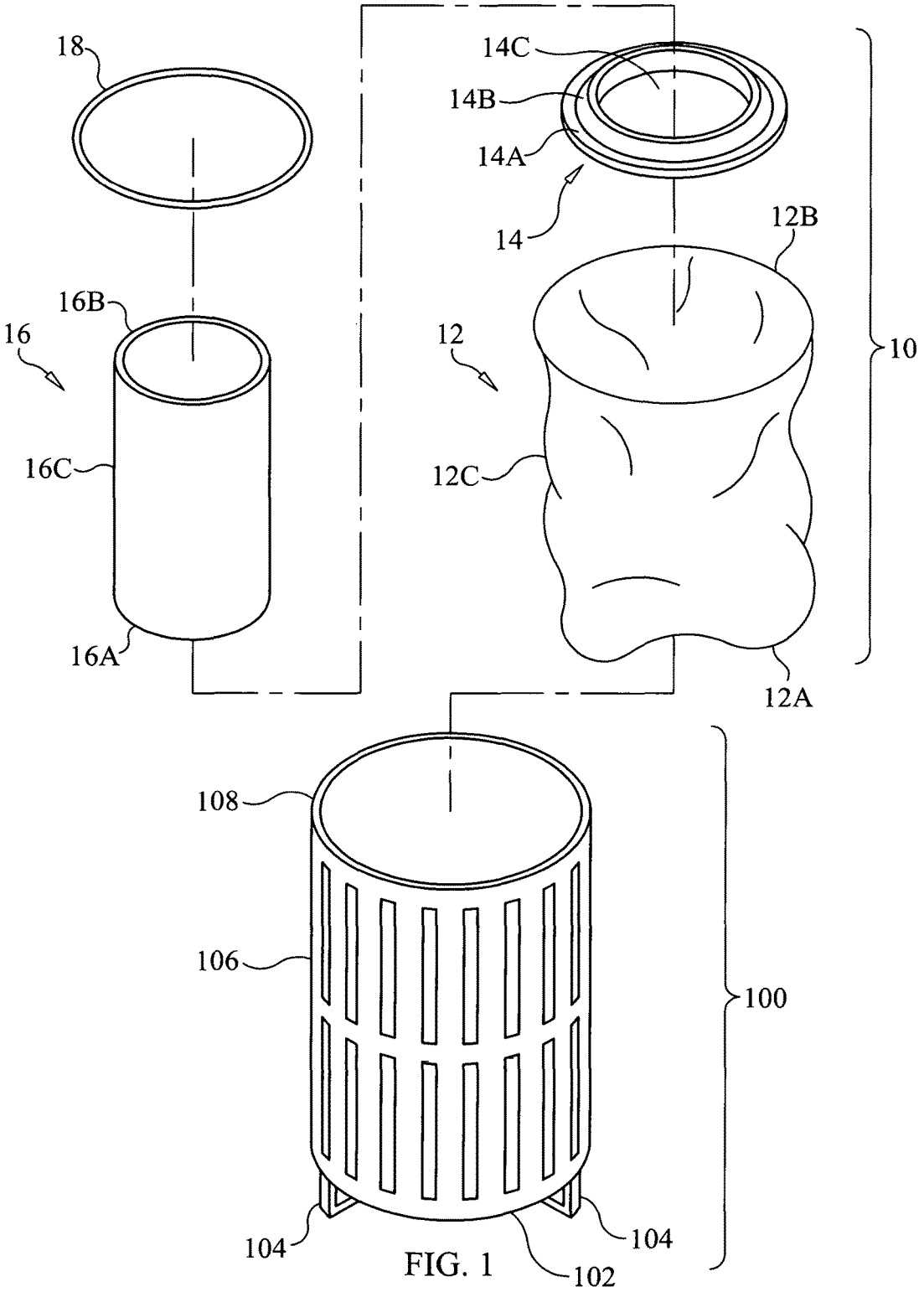
FIG. 1 is an exploded perspective view of portions of a blast containment system for a trash can prior to the filling thereof with a liquid in accordance with an embodiment of the present invention.
Figure 2:
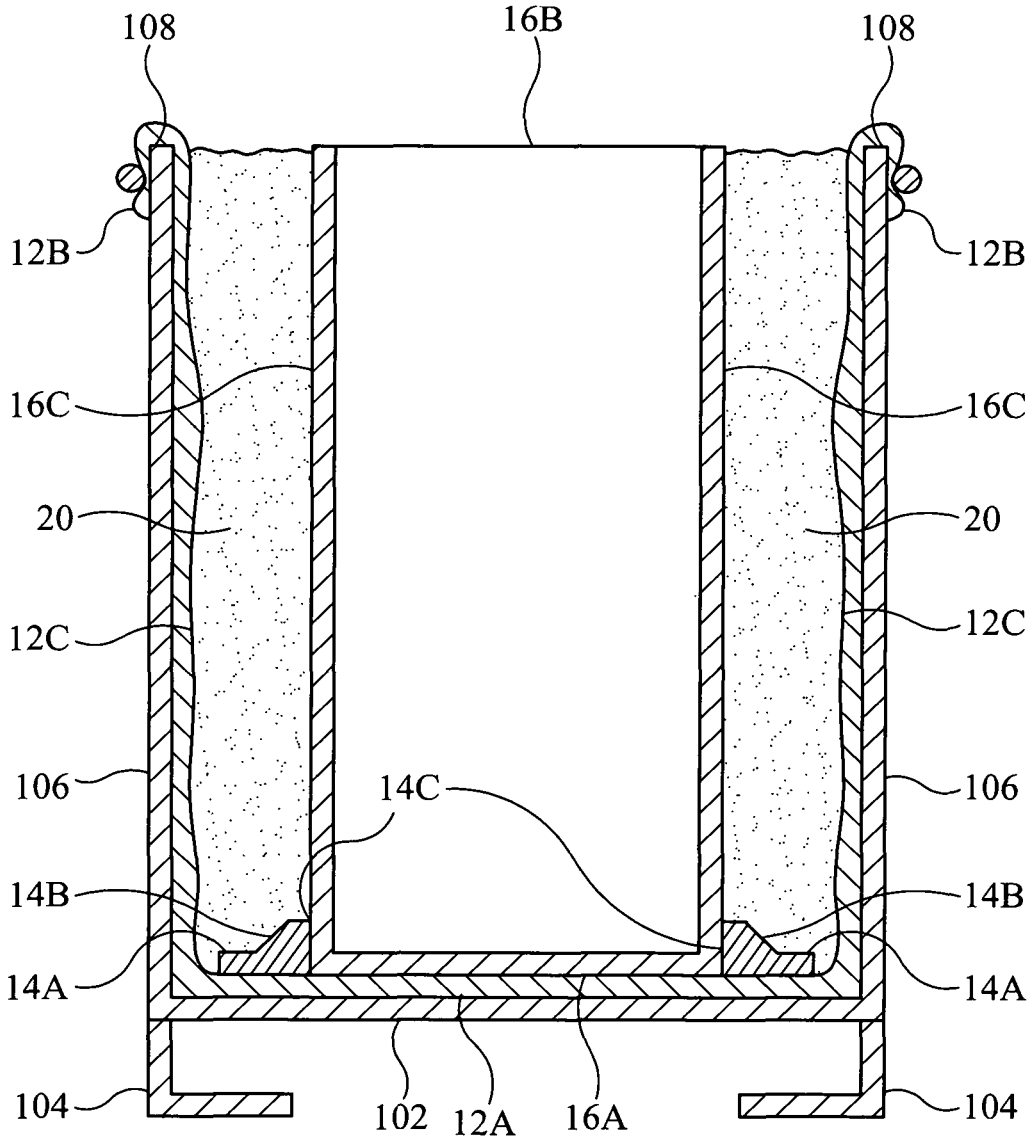
FIG. 2 is a cross-sectional view of an assembled and liquid-filled blast containment system for a trash can in accordance with an embodiment of the present invention.

Referring now to the drawings, simultaneous reference will be made to FIGS. 1 and 2 where a blast containment system for a trash can in accordance with an embodiment of the present invention is illustrated. In each figure, a conventional trash can 100 serves as the support structure for the blast containment system. In general, trash can 100 is made from a rigid material (e.g., metal, hard plastic, etc.) that has little to no blast containment attributes. As is well-known in the art, trash can 100 generally has a base 102 that can include legs/feet 104, and side walls 106 leading from base 102 up to an open top 108. A lid (not shown) can be provided for engagement with open top 108 where such a lid will generally be removable and/or have an opening through which trash can be deposited. A variety of trash can designs could be used to support a blast containment system of the present invention without departing from the scope of the present invention.

A blast containment system in accordance with an embodiment of the present invention includes a number of solid elements (referenced generally by numeral 10 in FIG. 1) and a liquid 20 (shown only in FIG. 2) disposed between some of solid elements 10. Solid elements 10 include a flexible bag 12, a ring-shaped boot 14, rigid container 16, and a retainer 18. Details and attributes of solid elements 10 and liquid 20 will be described further below.

In general, flexible bag 12 is made from a material that is impervious to liquid. Flexible bag 12 is sealed at one end 12A (i.e., the bottom of bag 12) and is unsealed or open at its opposing end 12B (i.e., the top of bag 12) with ends 12A and 12B being connected by side walls 12C. Bag 12 is sized such that sealed end 12A can rest on base 102 of trash can 100 while unsealed/open end 12B extends up to and beyond open top 108 of trash can 100 so that end 12B can be retained at open top 108 as will be explained further below. In addition to being impervious to liquid, bag 12 can be made from materials that have some blast and/or blast fragment containment properties. For example, bag 12 could be made from a natural or synthetic rubber with the entirety thereof or just its side walls 12C including one or more materials having ballistic-arresting properties (e.g., Kevlar, Lexan, graphene, carbon fibers, etc.).

Ring-shaped boot 14 includes an annular base 14A with an annular flange 14B integrated with base 14A and extending up therefrom. Annular flange 14B defines a central opening 14C in boot 14. Opening 14C can extend all the way through boot 14 (as shown) or just partially into boot 14 without departing from the scope of the present invention. Boot 14 can be made from a semi-flexible rubber material and is sized to form a snug or press-fit engagement with the base of rigid container 16.

Rigid container 16 serves as a refuse container and the first line of a blast containment defense provided by the blast containment system of the present invention. Rigid container 16 includes a closed bottom 16A, and side walls 16C extending up to an open top 16B. Container 16 is sized such that open top 16B is approximately aligned with open top 108 of trash can 100 when container 16 rests therein. The diameter of closed bottom 16A is sized slightly larger than the diameter of opening 14C such that bottom 16A can be press fit into opening 14C whereby annular flange 14B firmly engages side walls 16C of container 16. At least side walls 16C of container 16 are made from one or more ballistic materials such as ceramics, steal, titanium, rubber, Kevlar, Lexan, graphene, and carbon fibers. In general, container 16 is sized such that an annular volume is defined between side walls 12C and 16C that will be filled with liquid 20.

Retainer 18 can be a simple hoop of an elastic material used to hold unsealed/open end 12B of bag 12 at the periphery of open top 108 of trash can. For example and as illustrated, unsealed/open top 12B can be pulled over open top 108 with retainer 18 elastically engaging both a portion of side walls 12C and side walls 16C such that bag 12 is retained at open top 108. Retainer 18 can be a separate element (as shown), but could also be integrated into bag 12 at open top 12B in ways well-known in the art and without departing from the scope of the present invention. Retainer 18 could also be realized by clips that engage open top 12B and open top 108 to keep bag 12 in place. Accordingly, it is to be understood that retention of open end 12B at open top 108 can be achieved in a variety of ways without departing from the scope of the present invention.

In use, bag 12 is placed in trash can 100 and is retained in place by, for example, retainer 18. Boot 14 is placed in bag 12 where it rests on sealed end 12A that, in turn, is resting on base 102 of trash can 100. Container 16 is then press-fit into central opening 14C of boot 14. Liquid 20 is then used to fill the annular volume between side walls 12C and 16C.

Liquid 20 provides the second level or stage of ballast containment. Liquid 20 can be fresh or tap water, and can include one or more solutes to provide additional attributes. For example, liquid 20 could be a mixture of water and an antifreeze additive (e.g., salt) for use in cold environments. Additionally or alternatively, liquid 20 could be a mixture of water and a solute offering blast containment attributes such as cornstarch.

The advantages of the present invention are numerous. The blast containment system is relatively inexpensive and readily adaptable for use with a variety of trash can designs. The system is readily transported to a site/venue and may be installed in a matter of minutes.

Although the invention has been described relative to a specific embodiment thereof, there are numerous variations and modifications that will be readily apparent to those skilled in the art in light of the above teachings. For example, a drain port can be provided in flexible bag 12 to allow liquid 20 to be readily drained from the annular volume between walls 12C and 16C thereby allowing the system to be removed and reused. In addition, a flat ring could be attached to or integrated with open top 108 such that the flat ring would extend over the top of liquid 20 to keep refuse from inadvertently being deposited therein. Such a ring could also define a sloped surface towards open top 108 to direct any deposited towards open top 108. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed as new and desired to be secured by Letters Patent of the United States is:

1. A blast containment system for trash cans, comprising:

a flexible bag being adapted for positioning in a rigid trash can, said flexible bag includes a sealed bottom adapted to be positioned at a base of the trash can, said flexible bag includes an unsealed top adapted to be positioned and retained at a top periphery of the trash can, said flexible bag is impervious to liquid;

a ring-shaped boot being positioned at said sealed bottom of said flexible bag, said ring-shaped boot includes a central opening;

a rigid container including a closed bottom being press-fit into said central opening of said ring-shaped boot, said rigid container extends from said closed bottom to an open top thereof adapted to be approximately aligned with the top periphery of the trash can, wherein an annular volume is defined between said rigid container and said flexible bag, said rigid container includes side walls, which include ballistic materials; and a liquid filling said annular volume.

2. The blast containment system as in claim 1, further comprising a retainer for engaging said unsealed top of said flexile bag and for adapting to engage the top periphery of the trash can, wherein said unsealed top of said flexible bag is maintained at the top periphery of the trash can.

3. The blast containment system as in claim 2, wherein said retainer is integrated with said unsealed top of said flexible bag.

4. The blast containment system as in claim 1, wherein said flexible bag comprises a rubber material.

5. The blast containment system as in claim 1, wherein side walls of said flexible bag include at least one material selected from the group consisting of rubber, Kevlar, Lexan, graphene, and carbon fibers.

6. The blast containment system as in claim 1, wherein said liquid includes water.

7. The blast containment system as in claim 6, wherein said liquid includes at least one solute selected from the group consisting of an antifreeze additive and cornstarch.

8. The blast containment system as in claim 1, wherein said boot comprises a semi-flexible rubber material.

9. The blast containment system as in claim 1, wherein said ballistic materials comprising said side walls of said rigid container are selected from the group consisting of ceramics, steel, titanium, rubber, Kevlar, Lexan, graphene, and carbon fibers.

10. A blast containment system for trash cans, comprising:

a flexible bag being adapted for positioning in a rigid trash can, said flexible bag includes a sealed bottom adapted to be positioned at a base of the trash can, said flexible bag includes an unsealed top adapted to be positioned and retained at a top periphery of the trash can, said flexible bag is impervious to liquid;

a retainer for engaging said unsealed top of said flexile bag and being adapted for engaging the top periphery of the trash can, wherein said unsealed top of said flexible bag is maintained at the top periphery of the trash can;

a rubber boot being positioned at said sealed bottom of said flexible bag, said rubber boot includes a central opening;

a rigid container including a closed bottom press-fit into said central opening of said rubber boot, said rigid container extends from said closed bottom to an open top thereof adapted to be approximately aligned with the top periphery of the trash can, wherein an annular volume is defined between said rigid container and said flexible bag, said rigid container having side walls that include ballistic materials; and a liquid filling said annular volume.

11. The blast containment system as in claim 10, wherein said retainer is integrated with said unsealed top of said flexible bag.

12. The blast containment system as in claim 10, wherein side walls of said flexible bag include at least one material selected from the group consisting of rubber, Kevlar, Lexan, graphene, and carbon fibers.

13. The blast containment system as in claim 10, wherein said liquid includes water.

14. The blast containment system as in claim 13, wherein said liquid includes at least one solute selected from the group consisting of an antifreeze additive and cornstarch.

15. The blast containment system as in claim 10, wherein said ballistic materials comprising said side walls of said rigid container are selected from the group consisting of ceramics, steel, titanium, rubber, Kevlar, Lexan, graphene, and carbon fibers.

16. A blast containment system for trash cans, comprising:

a flexible bag being adapted for positioning in a rigid trash can, said flexible bag includes a sealed bottom adapted to be positioned at a base of the trash can, said flexible bag includes an unsealed top adapted to be positioned and retained at a top periphery of the trash can, said flexible bag is impervious to liquid;

a retainer for engaging said unsealed top of said flexile bag and adapted for engaging the top periphery of the trash can, wherein said unsealed top of said flexible bag is maintained at the top periphery of the trash can;

a ring-shaped boot being positioned at said sealed bottom of said flexible bag, said ring-shaped boot includes a central opening;

a rigid container including a closed bottom press-fit into said central opening of said ring-shaped boot, said rigid container extends from said closed bottom to an open top thereof adapted to be approximately aligned with the top periphery of the trash can, wherein an annular volume is defined between said rigid container and said flexible bag, said rigid container includes side walls, which include ballistic materials; and a liquid filling said annular volume, wherein said liquid includes water and at least one solute selected from the group consisting of an antifreeze additive and cornstarch.

17. The blast containment system as in claim 16, wherein said retainer is integrated with said unsealed top of said flexible bag.

18. The blast containment system as in claim 16, wherein side walls of said flexible bag include at least one material selected from the group consisting of rubber, Kevlar, Lexan, graphene, and carbon fibers.

19. The blast containment system as in claim 16, wherein said boot comprises a semi-flexible rubber material.

20. The blast containment system as in claim 16, wherein said ballistic materials comprising said side walls of said rigid container are selected from the group consisting of ceramics, steel, titanium, rubber, Kevlar, Lexan, graphene, and carbon fibers.

* * * * *